US008792803B2

(12) United States Patent
Imai

(10) Patent No.: US 8,792,803 B2
(45) Date of Patent: Jul. 29, 2014

(54) HOUSING ENGAGEMENT STRUCTURE AND IMAGE FORMATION APPARATUS WITH WALLS HAVING OVERLAP PORTIONS

(75) Inventor: Manabu Imai, Tokyo (JP)

(73) Assignee: Oki Data Corporation, Tokyo (JP)

( * ) Notice: Subject to any disclaimer, the term of this patent is extended or adjusted under 35 U.S.C. 154(b) by 348 days.

(21) Appl. No.: 13/106,969

(22) Filed: May 13, 2011

(65) Prior Publication Data

US 2011/0280615 A1 Nov. 17, 2011

(30) Foreign Application Priority Data

May 17, 2010 (JP) ..... 2010-113093

(51) Int. Cl.
*G03G 15/00* (2006.01)
*B65D 55/14* (2006.01)

(52) U.S. Cl.
USPC ..... 399/107; 399/125; 70/158

(58) Field of Classification Search
USPC ..... 399/107, 125; 312/326; 70/158, 159, 70/163, 166, 167; 5/107, 125
See application file for complete search history.

(56) References Cited

FOREIGN PATENT DOCUMENTS

| | | | |
|---|---|---|---|
| JP | 04-033569 U | * | 3/1992 |
| JP | 2004-167728 A | | 6/2004 |
| JP | 2006178338 A | * | 7/2006 |

* cited by examiner

*Primary Examiner* — Billy Lactaoen
(74) *Attorney, Agent, or Firm* — Marvin A. Motsenbocker; Mots Law, PLLC

(57) ABSTRACT

A housing engagement structure used for a housing to accommodate therein an apparatus body includes a first housing member and a second housing member. The first housing member includes a first wall having a first overlap portion being an end of the first wall. The second housing member includes: a second wall having a second overlap portion being an end of the second wall configured to be in contact with an inner surface of the first overlap portion and overlapped with the first overlap portion; and a first reinforcement rib projected from the inner surface of the second wall and extending to a position to be in contact with an inner surface of the first wall in the vicinity of the first overlap portion thereby reinforcing the first overlap portion.

20 Claims, 19 Drawing Sheets

(b)

HOUSING ENGAGEMENT STRUCTURE AND IMAGE FORMATION APPARATUS WITH WALLS HAVING OVERLAP PORTIONS

CROSS REFERENCE TO RELATED APPLICATIONS

This application claims priority based on 35 USC 119 from prior Japanese Patent Application No. 2010-113093 filed on May 17, 2010, entitled "Housing Engagement Structure and Image Formation Apparatus", the entire contents of which are incorporated herein by reference.

1. FIELD OF THE INVENTION

The invention relates to a housing engagement structure and an image formation apparatus, such as an electrophotographic printer, a copy machine, a facsimile machine, or the like, using the same.

2. DESCRIPTION OF RELATED ART

Conventionally, the housing of a device such as an image formation apparatus or the like is made up of plural housing members, in general. Where two of the housing members are engaged with each other, the outer surfaces of the two housing members are placed in a line such that a gap between the two housing members is designed small, so as to maintain a good appearance.

Japanese Patent Application Laid-Open No. 2004-167728 discloses an art relating to such a housing. In Japanese Patent Application Laid-Open No. 2004-167728, a cover, which is a part of a housing of an image formation apparatus, is rotatably attached to a housing body of the image forming apparatus. In the state where the cover is closed with respect to the housing body, the cover is engaged with the housing body.

SUMMARY OF THE INVENTION

However, in the conventional configuration, a gap between the two housing members is highly likely to occur.

An object of an aspect of the invention is to provide a structure capable of preventing a gap between two housing members.

A first aspect of the invention is a housing engagement structure used for a housing in which an apparatus main body is accommodated. The housing engagement structure includes a first housing member and a second housing member. The first housing member includes a first wall having a first overlap portion being an end of the first wall. The second housing member includes: a second wall having a second overlap portion being an end of the second wall configured to be in contact with an inner surface of the first overlap portion of the first wall to be overlapped with the first overlap portion of the first wall; and a first reinforcement rib projected from the inner surface of the second wall and extending to a position to be in contact with the inner surface of the first wall in the vicinity of the first overlap portion thereby reinforcing the first overlap portion.

A second aspect of the invention is an image formation apparatus including: the housing having the housing engagement structure according to the first aspect; and an image formation apparatus main body configured to form an image on a medium and accommodated in the housing.

According to the aspects, a gap between two housing member is unlikely to occur.

DETAILED DESCRIPTION OF THE EMBODIMENTS

Figure 1A:
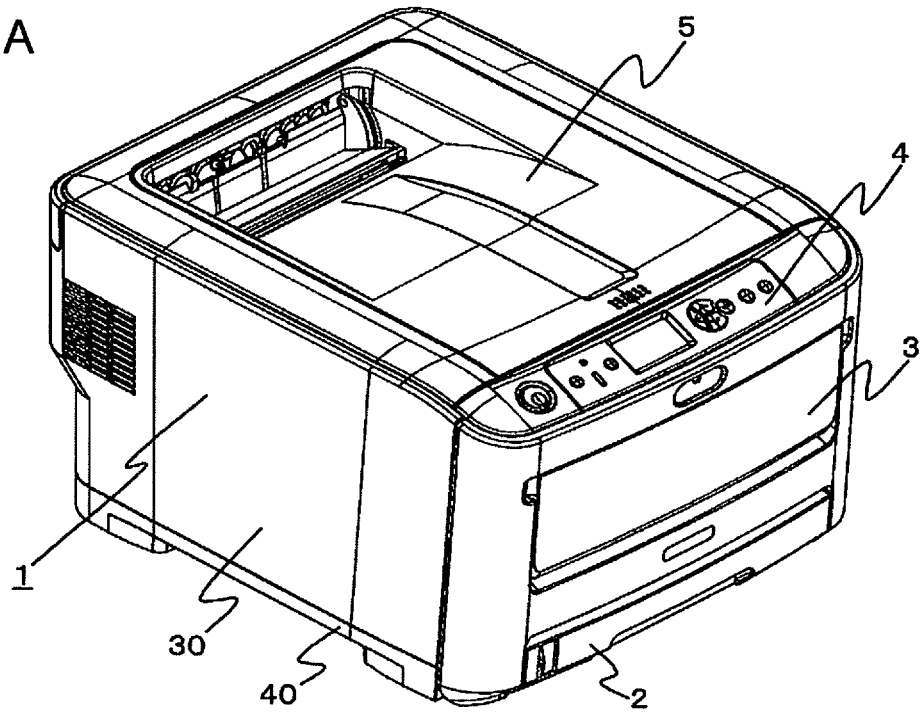
FIGS. 1A and 1B are configuration diagrams illustrating the image formation apparatus according to the first embodiment of the invention.

Descriptions are provided herein below for embodiments based on the drawings. In the respective drawings referenced herein, the same constituents are designated by the same reference numerals and duplicate constituents are designated by the same reference numerals and duplicate explanation concerning the same constituents is omitted. All of the drawings are provided to illustrate the respective examples only.

First Embodiment

Configuration of First Embodiment

Figure 1B:
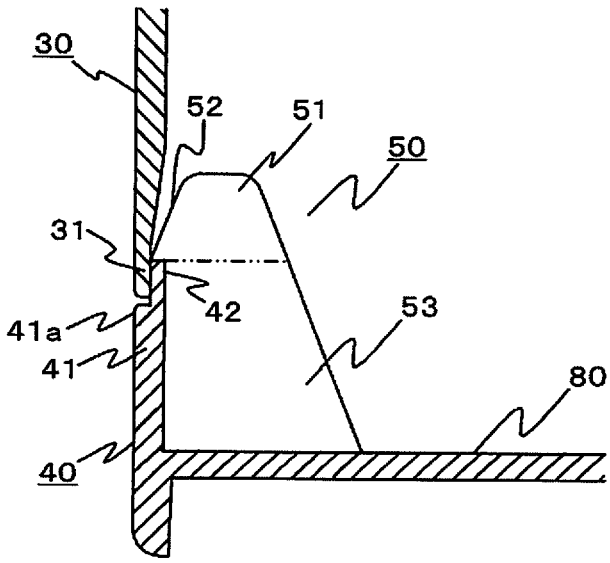

FIGS. 1A and 1B are configuration diagrams illustrating an image formation apparatus according to a first embodiment of the invention, wherein FIG. 1A is a perspective view illustrating an exterior appearance of the image formation apparatus and FIG. 1B is an enlarged sectional view illustrating a part of the image formation apparatus.

As shown in FIGS. 1A and 1B, the image formation apparatus of the first embodiment is an electrophotographic page printer, for example. The image formation apparatus includes a housing in which an apparatus main body or a printer engine is accommodated. The housing includes: bottom wall 80 on which the apparatus body is placed, four lateral side walls (a front side wall, a right side wall, a left side wall, a rear side wall) which define and encircle an accommodation space above bottom wall 80; and an upper wall covering an upper side of the accommodation space defined by the lateral walls. Side wall 1 (the right side wall in the first embodiment) is provided with cover 30 (a first housing member), which is a part of the housing.

Sheet cassette 2 is provided at a lower portion of the front side wall, and manual paper feed tray 3 is provided above sheet cassette 2. Provided at an upper end portion of the front side wall is operation panel 4 including therein lamps, a message display, or the like to inform the user of the status of the state of the apparatus, operation buttons, and the like. Discharged sheet stacker 5 on which printed sheets are to be stacked is provided at the upper wall.

FIG. 1B illustrates the housing engagement structure provided at a lower portion of side wall 1 according to the first embodiment. Base 40 (a second wall of a second housing member) is a lower portion of side wall 1 and is upwardly projected from a periphery of bottom wall 80 (a third wall of the second housing member). Cover 30 is provided above and attached to base 40. Cover 30 and base 40 make up side wall 1 of the housing. In the state where cover 30 is attached to base 40, overlap portion 42 of base 40 (a first overlap portion), which is an upper end of base 40, is overlapped with overlap portion 31 of cover 30 (a second overlap portion), which is a lower end of cover 30. Overlap portion 42, which is the upper end of base 40, is thinner than base body 41 (a second wall body) of base 40 with step 41*a* at the boundary between base body 41 and overlap portion 42. In other words, the upper end of base 40 is formed with a notch or a recess (denoted by reference number 41*b* in FIG. 5) on its outer side. Overlap portion 31, which is the lower end of cover 30, has a thickness such that overlap portion 31 is accommodated in notch 41*b* facing overlap portion 42 of base 40.

For example, the thickness of base body 41 is 2 to 2.5 mm while the thickness of overlap portion 42 is 1 to 1.5 mm.

The inner surface of cover 30 is obliquely cut such that the thickness of covey 30 gets thinner as it goes from a body of cover 30 (a first wall body) toward overlap portion 31, which is the lower end of cover 30.

The inner surface of overlap portion 42 is formed with first reinforcement ribs 50 (50-1, 50-2, . . . , 50-N) projected from and substantially orthogonal to bottom wall 80 and base 40. Each of first reinforcement ribs 50 includes rib body 53 and extension 51. Rib body 53 is provided at an area facing base body 41 and overlap portion 42. Extension 51 is upwardly projected from an upper end of rib body 53, which corresponds to an upper end of overlap portion 42. An outer side of extension 51, which is a side of extension 51 that faces overlap portion 31 of cover 30, is smoothly connected to the outer surface of overlap portion 42. The outer side of extension 51 is inclined face 52 slanted inwardly (that is, slanted away from cover 30) as it goes from the lower end of extension 51 (the upper end of rib body 53) toward the upper end of extension 51.

Figure 2:
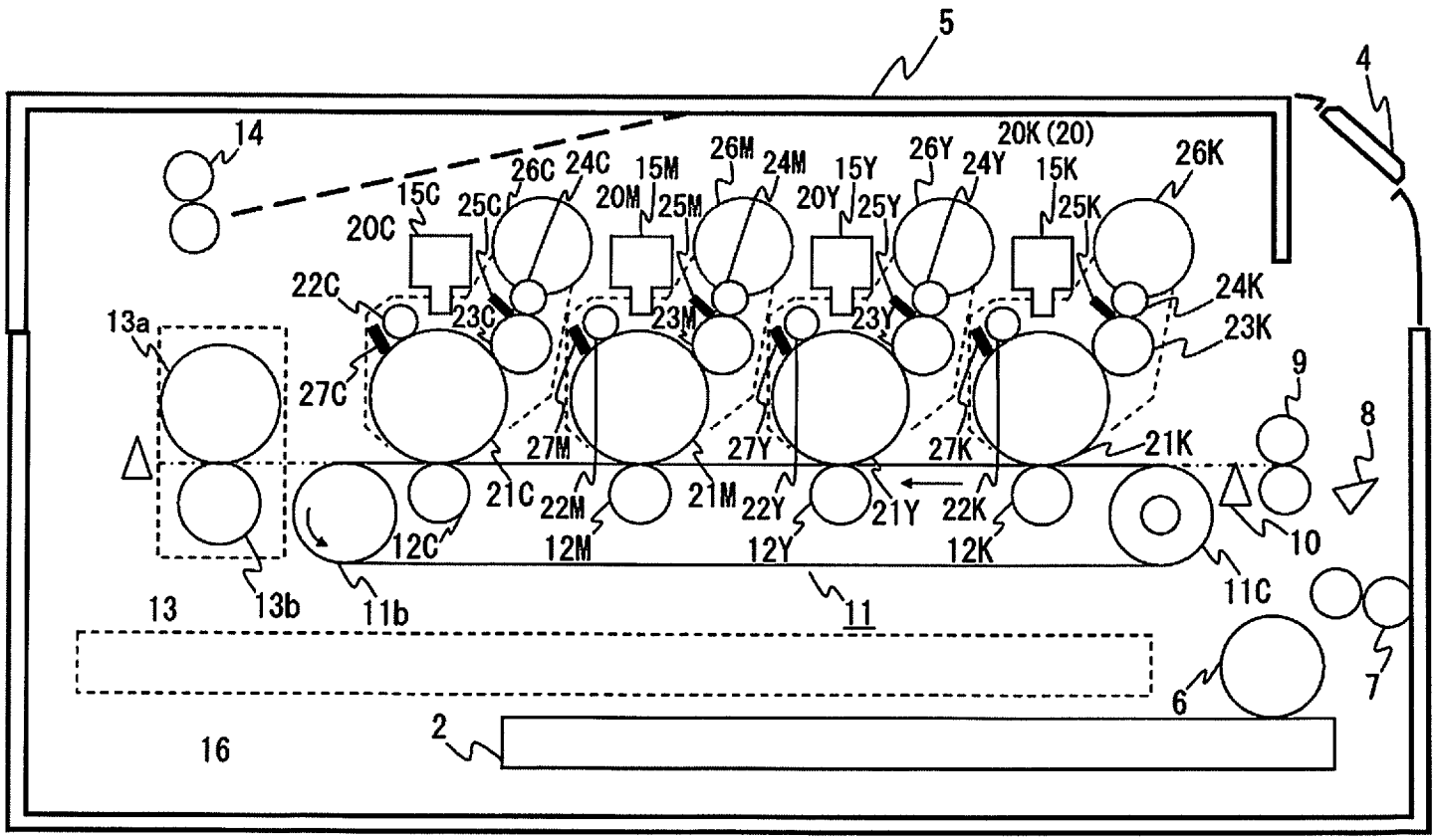
FIG. 2 is a configuration diagram schematically illustrating the configuration inside of the image formation apparatus of FIG. 1.

FIG. 2 is a configuration diagram schematically illustrating the inside structure of the image formation apparatus of FIG. 1. The image formation apparatus includes image formation units 20 (=20K, 20Y, 20M, and 20C) for respective colors of black (C), yellow (Y), magenta (M), and cyan (C) at approximately a center section of the inner space of the housing. Provided beneath image formation units 20 are image transfer unit 11 which includes: conveyance belt 11*a* being an endless belt to convey recording sheets P; driving roller 11*b* to drive conveyance belt 11*a*; and driven roller 11*c* to be rotationally driven by the rotation of driving roller 11*b*, so that image transfer unit 11 can covey recording sheets P at predetermined times.

Image transfer rollers 12K, 12Y, 12M, and 12C are provided beneath image formation units 20 with conveyance belt 11*a* interposed therebetween.

Provided beneath image transfer unit 11 are sheet cassette 2 to store therein recording sheets P and feed roller 6 to sequentially feed recording sheets P from sheet cassette 2 with a separating tongue or the like. Provided downstream of recording sheet P in the sheet conveyance direction are: first conveyance roller 7 to convey recording sheet P; inlet sensor 8 to detect the approach of recording sheet P to image transfer unit 11; second conveyance roller 9 to convey recording sheet P to image transfer unit 11; and write sensor 10 to detect the time to write an image on recording sheet P.

Provided downstream of image transfer unit 11 is fixation unit 13. Fixation unit 13 has a heating element such as a halogen lamp or the like and is configured to fix toner (developer) to recording sheet P by heating and pressing recording sheet P. Fixation unit 13 includes fixation roller 13*a* and backup roller 13*b*. Discharge roller 14 is provided downstream of fixation unit 13, to discharge recording sheet P out of the apparatus. Reverse unit 16 for double-side printing is provided beneath image transfer units 11. Reverse unit 16 functions, upon double-side printing, to convey recording sheet P from downstream of fixation unit 13 to upstream of image formation unit 20K while turning recording sheet P over.

Image formation units 20 includes, for respective colors of black (C), yellow (Y), magenta (M), and cyan (C), photosensitive drums 21 (=21K, 21Y, 21M, and 21C), charging rollers 22 (=22K, 22Y, 22M, and 22C), development rollers 23 (=23K, 23Y, 23M, and 23C), toner supplying sponge rollers 24 (=24K, 24Y, 24M, and 24C), development blades 25 (=25K, 25Y, 25M, and 25C), toner tanks 26 (=26K, 26Y, 26M, and 26C), and cleaning devices 27 (=27K, 27Y, 27M, and 27C).

Light emitting diode heads (hereinafter, referred to as LED heads) 15 (=15K, 15Y, 15M, and 15C) or exposure devices are provided above photosensitive drums 21, respectively. LED heads 15 are configured to radiate light to form an electrostatic latent image on photosensitive drums 21.

Each photosensitive drum 21 functions to carry thereon an electrostatic latent image and a developer image (for example, an toner image) being a visible image which is developed by supplying unillustrated developer (for example, toner) to the electrostatic latent image. Charging rollers 22 are configured to charge the surface of photosensitive drum 21. LED head 15 is configured to form an electrostatic latent image on the charged surface of photosensitive drum 21. Development roller 23 functions to visualize the electrostatic latent image on the surface of photosensitive drum 21 by supplying toner to photosensitive drum 21.

Each toner supplying sponge roller 24 functions to supply toner from toner tanks 26 to development roller 23. Development blades 25 functions to uniformly form a thin toner layer on development roller 23 by metering the toner on development roller 23. Cleaning devices 27 functions to remove toner remaining on photosensitive drum 21.

Figure 3:
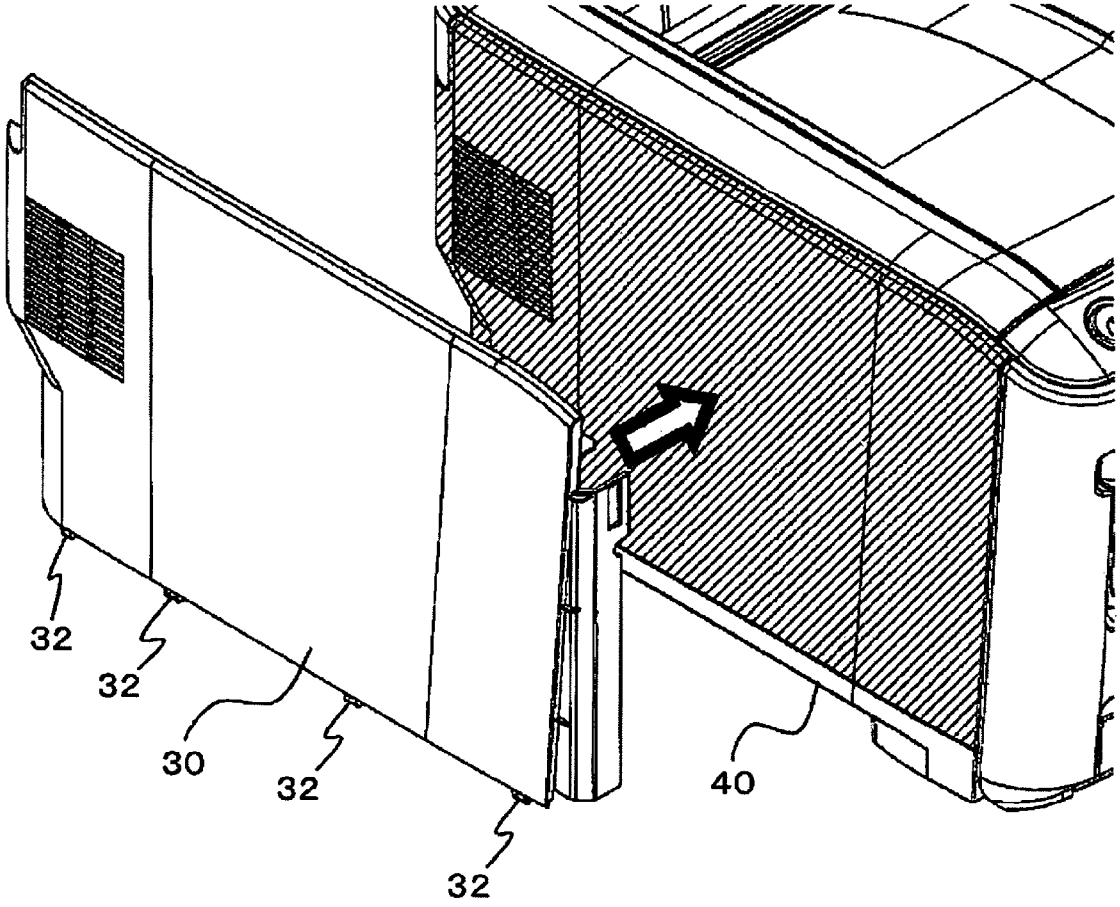
FIG. 3 is a perspective view illustrating a side wall of the image formation apparatus of FIG. 1.

FIG. 3 is a perspective view illustrating side wall 1 of the image formation apparatus of FIG. 1. At the lower portion of side wall 1 of the image formation apparatus, there is base 40 extending from the periphery of bottom wall 80. Cover 30 which functions as a part of the exterior of the image formation apparatus is provided above and attached to base 40. The lower end of cover 30 is formed with positioning projections 32 at regular intervals along the longitudinal direction of the lower end of cover 30. Positioning projections 32 of cover 30 are to be fit in positioning recess 45 (see FIG. 5) of base 40.

Figure 4:
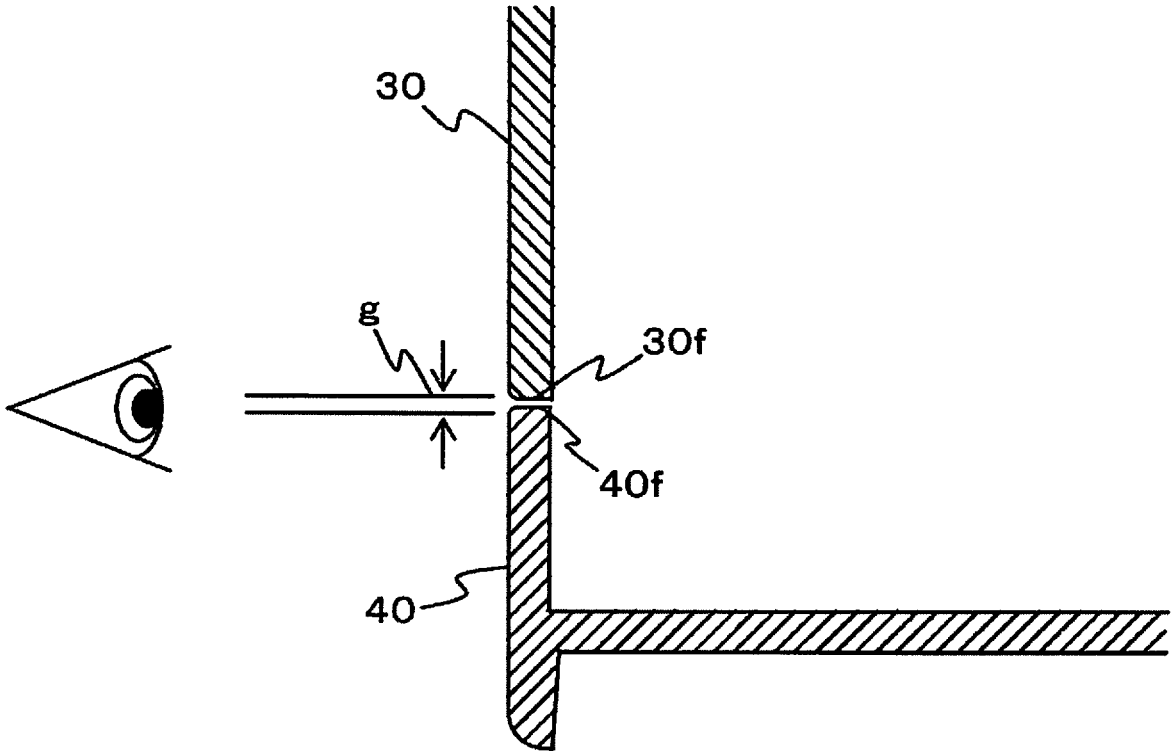
FIG. 4 is a sectional view of a housing engagement structure according to a comparison example.

FIG. 4 is a sectional view of a housing engagement structure according to a comparison example. In the comparison example shown in FIG. 4, at the parting line between cover 30 and base 40, a lower end surface 30*f* of cover 30 and an upper end surface 40*f* of base 40 are arranged parallel and facing each other with gap "g" therebetween. Gap g between the lower end surface 30*f* and the upper end surface 40*f* is designed small, in order to improve the appearance of the apparatus.

Figure 5:
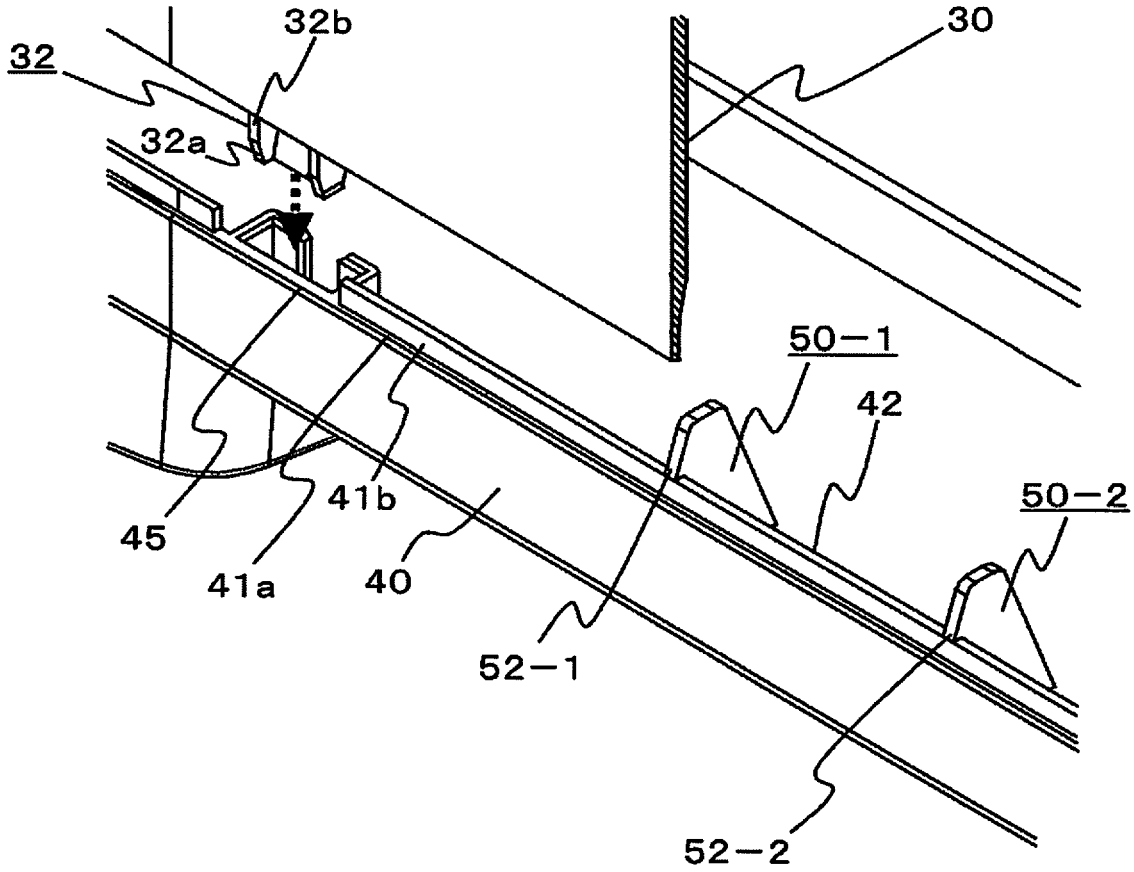
FIG. 5 is a perspective view illustrating the housing engagement structure of the side wall shown in FIG. 3.

FIG. 5 is a perspective view illustrating the housing engagement structure of side wall 1 shown in FIG. 3. The lower end of cover 30 is formed with positioning projections 32 serving as positioning portions or engagement portions. The upper end of base 40 is formed with positioning recesses 45 serving as positioning portions or engagement portions at locations corresponding to positioning projections 32. The end of positioning projection 32 includes inclined surface 32*a* and opposed surface 32*b* to be opposed to the inner surface of base 40. The upper end of base 40 comprises overlap portion 42 with notch 41*b* on its outer side. The inner surface of base 40 is formed with first reinforcement ribs 50 (50-1, 50-2, . . . , 50-N) each of which has inclined face 52.

Figure 6A:
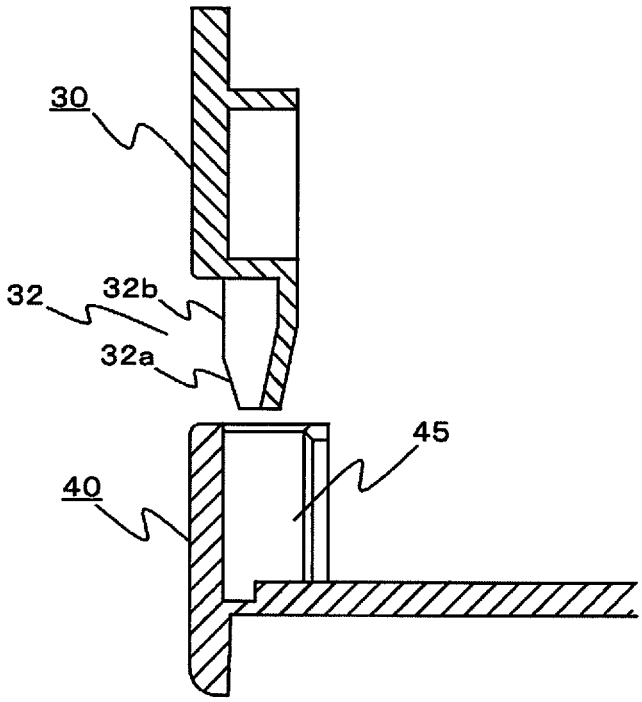
FIG. 6 is a sectional view illustrating a fitting structure between a positioning projection and a positioning recess shown in FIG. 5.
Figure 6B:
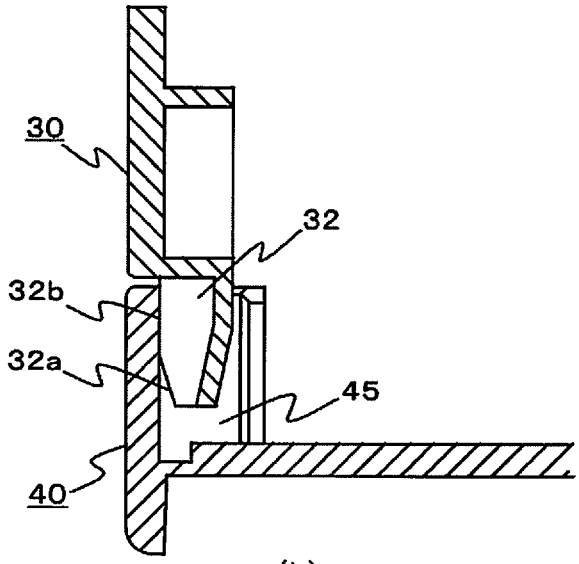

FIGS. 6A and 6B are sectional views illustrating a fitting structure between positioning projection 32 and positioning recess 45 shown in FIG. 5.

FIG. 6A illustrates a state where positioning projection 32 and positioning recess 45 are spaced away from each other, whereas FIG. 6B illustrates a state where positioning projection 32 and positioning recess 45 are fit to each other. Positioning projection 32 is projected downwardly from cover 30 and is formed with inclined surface 32 and opposed surface 32*b* to be opposed to the inner surface of base 40. The inner surface of base 40 is formed with positioning recess 45 at a location facing positioning projection 32 so that positioning projection 32 can be fit into positioning recess 45. The presence of positioning projection 32 and positioning recess 45 ensures the engagement between cover 30 and base 40, thereby preventing cover 30 from extending outward from the housing.

(General Operation of the Image Formation Apparatus of First Embodiment)

In FIG. 2, recording sheets P set in sheet cassette 2 are sequentially fed by feed roller 6 and conveyed to image transfer unit 11 by first conveyance roller 7 and second conveyance roller 9. In each image formation unit 20, the surface of photosensitive drum 21 is uniformly charged by charging roller 22. A print job received from an un-illustrated external apparatus (for example, a host computer) is transmitted to LED head 15 via an illustrated controller. Then LED head 15 emits light thereby forming an electrostatic latent image according the print pattern of the print job on photosensitive drum 21.

Development roller 23, which is in contact with photosensitive drum 21, attaches toner to the electrostatic latent image on photosensitive drum 21 thereby forming a toner image on photosensitive drum 21. Then, the toner image on photosensitive drum 21 is transferred onto recording sheet P by means of an electric field between image transfer roller 12 and photosensitive drum 21. The toner image on recording sheet P is fixed to recording sheet P by fixation unit 13 heating and pressing recording sheet P. Recording sheet P having the toner image thereon is discharged out of the image formation apparatus via discharge roller 14 and is thus stacked on discharged sheet stacker 5.

(Function of the Housing Engagement Structure According to First Embodiment)

Figure 7:
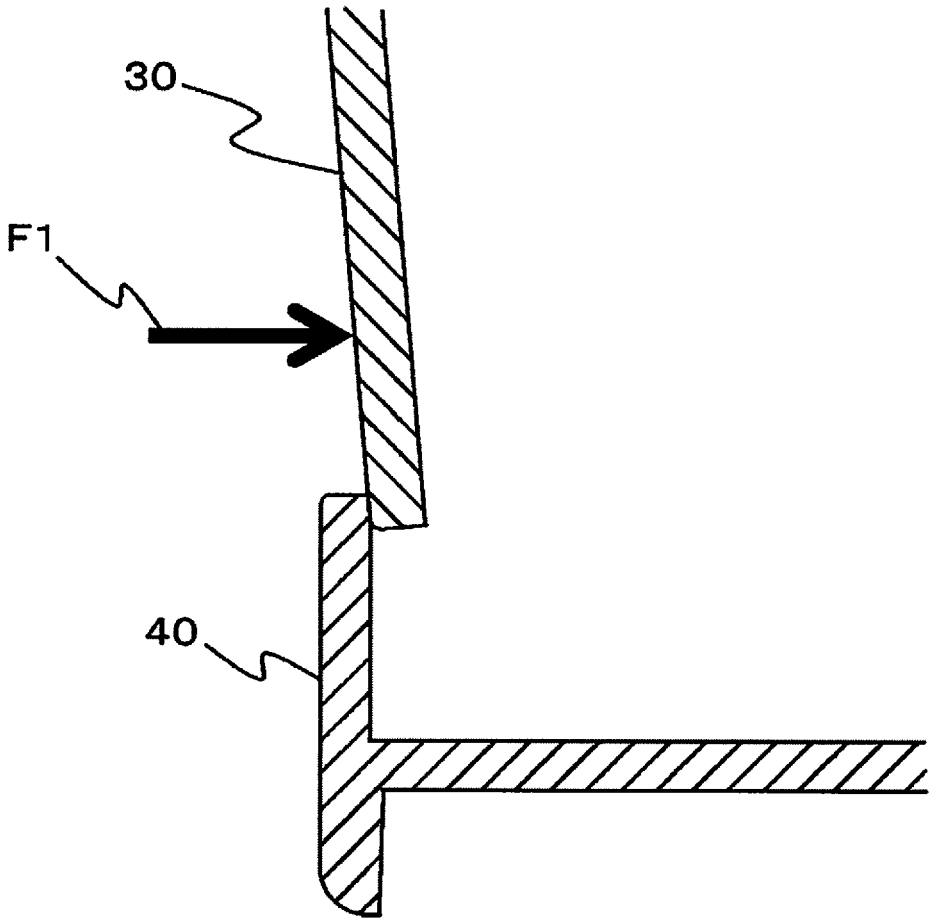
FIG. 7 is a sectional view illustrating a state where external force F1 is applied to the housing engagement structure of FIG. 4 according to the comparison example.
Figure 8:
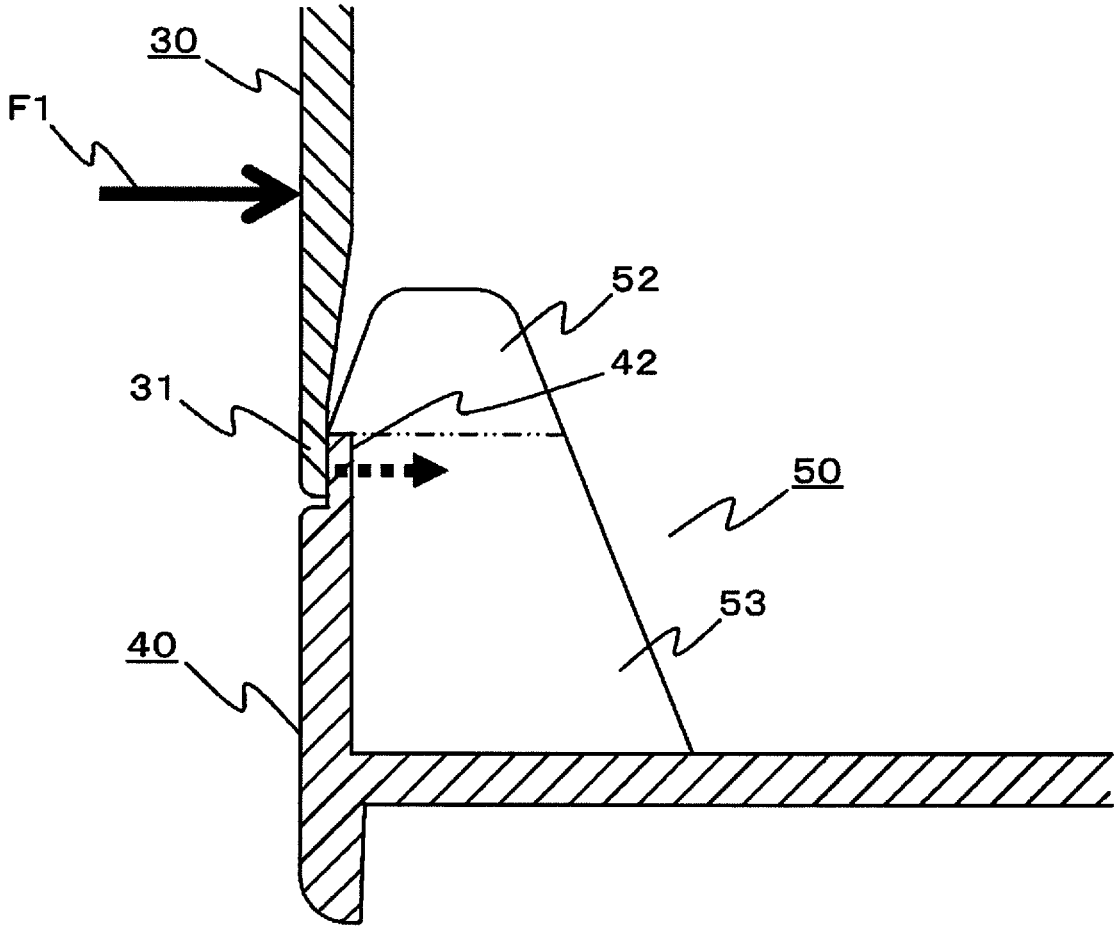
FIG. 8 is a sectional view illustrating a state where external force F1 is applied to the housing engagement structure of FIG. 1B.

FIG. 7 is a sectional view illustrating a state where external force F1 is applied to the housing engagement structure of the comparison example shown in FIG. 4. FIG. 8 is a sectional view illustrating a state where external force F1 is applied to the housing engagement structure of FIG. 1B.

The case where external force F1 orthogonal to the surface of cover 30 is applied to cover 30 will be described below.

As shown in FIG. 7, in the comparison example of the housing engagement structure, when external force F1 orthogonal to the surface of cover 30 is applied to cover 30, cover 30 is deformed inwardly and may get stuck with the inner surface of base 40.

In contrast, according to the configuration of the housing engagement structure of the first embodiment, as shown in FIG. 8, when external force F1 orthogonal to the surface of cover 30 is applied to cover 30, force F1 is applied orthogonally to overlap portion 42 via overlap portion 31 facing overlap portion 42. Force F1 that is orthogonally applied is received and stopped by reinforcement ribs 50, thereby maintaining the engagement between cover 30 and base 40.

Figure 9:
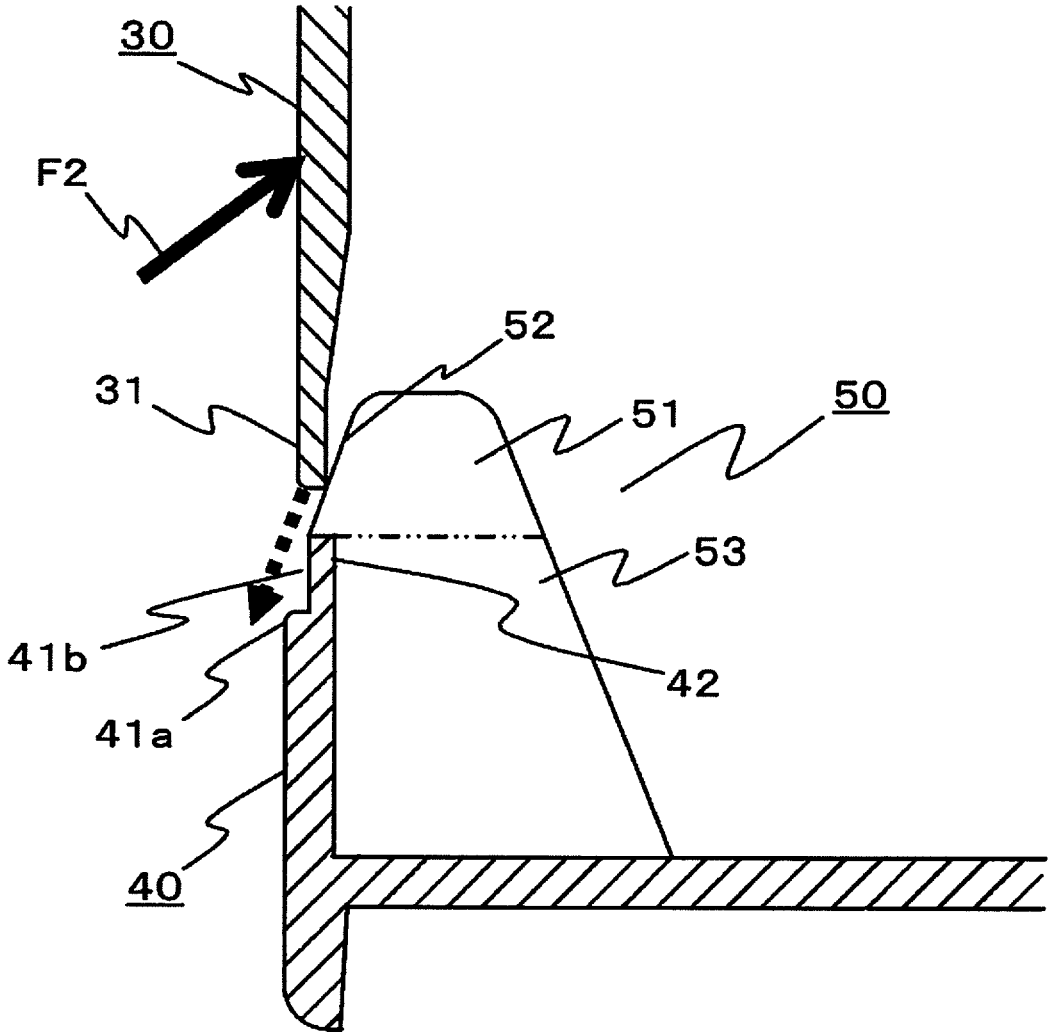
FIG. 9 is a sectional view illustrating a state where external force F2 is applied to the housing engagement structure of FIG. 1B.

FIG. 9 is a sectional view illustrating a state where external force F2 is applied to the housing engagement structure of FIG. 1B.

The case where external force F2, which is oblique to the surface of cover 30, is applied to cover 30 by an external cause will be described below.

As shown in FIG. 9, when external force F2, which is oblique to the surface of cover 30, is applied to cover 30, cover 30 is elastically deformed and overlap portion 31 of cover 30 slides upward along inclined faces 52 of reinforcement ribs 50 along extension 51. After that, when external force F2 disappears, overlap portion 31 of cover 30 slides downwardly along inclined faces 52 of reinforcement ribs 50 to the initial position by the elastic restoring force of cover 30. Accordingly, overlap portion 31 and overlap portion 42 are in contact with each other, maintaining the engagement between cover 30 and base 40.

Figure 10:
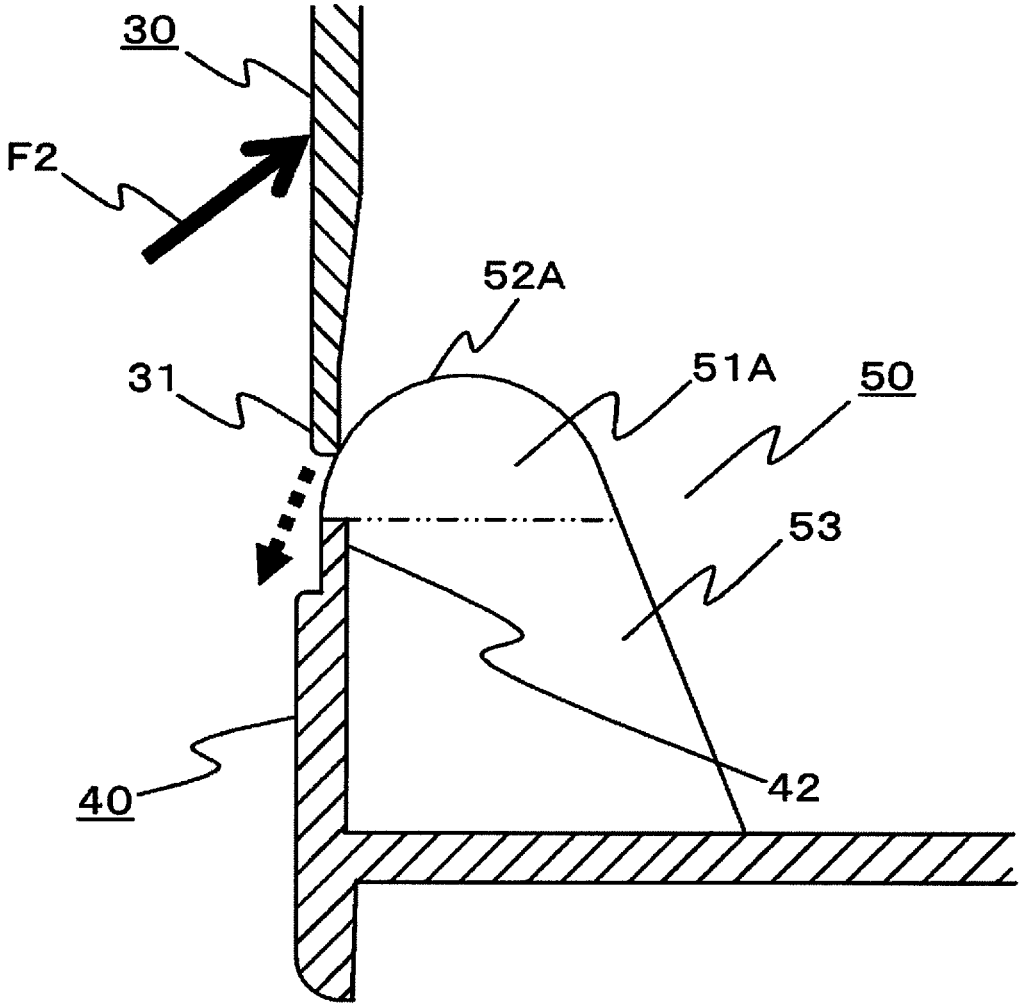
FIG. 10 is a sectional view illustrating a state where external force F2 is applied to a modification of the housing engagement structure of FIG. 1B.

FIG. 10 is a sectional view illustrating a state where external force F2 is applied to a modification of the housing engagement structure of FIG. 1

As shown in FIG. 10, in this modification, extension 51A of each reinforcement rib 50 is formed in a circular arc shape, that is, extension 51A has arc face 52A being an edge of extension 51A. Reinforcement ribs 50 are formed at base 40 along the longitudinal direction of the upper end of base 40. With this configuration, when external force F2, which is oblique to the surface of cover 30, is applied to cover 30, cover 30 is elastically deformed and overlap portion 31 of cover 30 slides upward along arc faces 52A of reinforcement ribs 50 along extension 51A. After that, when external force F2 is released, overlap portion 31 of cover 30 slides downward along arc faces 52A of reinforcement ribs 50 to the initial position by the elastic restoring force of cover 30, whereby overlap portion 31 and overlap portion 42 are in contact with each other, maintaining the engagement between cover 30 and base 40.

Note that, as shown in FIG. 9 or FIG. 10, when an operator attaches cover 30 to the image formation apparatus, the operator can insert positioning projection 32 of cover 30 into positioning recess 45 of base 40 by making overlap portion 31 of cover 30 slide along inclined face 52 or arc face 52A of reinforcement ribs 50. With this, the operation of attachment of cover 30 becomes easy.

(Effects of First Embodiment)

The housing engagement structure and the image formation apparatus according to the first embodiment achieve the following effects (1) to (4).

(1): According to the first embodiment, the lower end 31 (a first overlap portion) of cover 30 (a first housing member or a first wall of the first housing member) and the upper end 42 (a second overlap portion) of base 40 (a second wall of a second housing member) face and are in contact with each other. With this, when external force F1 orthogonal to the surface of cover 30 is applied to cover 30 by an external cause, force F1 is received by base 40, maintaining the engagement between cover 30 and base 40. This prevents deterioration of the appearance of the apparatus and prevents a gap which may allow foreign material to enter into the apparatus, thereby preventing malfunction of the apparatus.

(2): The inner surface of base 40 is formed with reinforcement ribs 50 orthogonal to base 40 along the inner surface of base 40 and each of reinforcement ribs 50 includes extension 51 or 51A extending upward higher than overlap portion 42.

With this configuration, when external force F1 orthogonal to the surface of cover 30 is applied to cover 30, force F1 is applied to base 40 and is received by reinforcement ribs 50 so that reinforcement ribs 50 prevent base 40 from bending. Therefore, even when an external force is applied to the housing, deterioration of the appearance of the apparatus is prevented, thereby preventing a gap which may allow foreign material to enter into the housing and thus preventing malfunction of the apparatus.

(3): The side of extension 51 or 51A of reinforcement rib 50 that faces the inner surface of cover 30 is inclined face 52 or arc face 52A slanted inward as it goes upward. Therefore, when external force F2, which is oblique to the surface of cover 30, is applied to cover 30, cover 30 is elastically deformed and overlap portion 31 of cover 30 slides upward on inclined faces 52 or arc faces 52A of reinforcement ribs 50. When external force F2 disappears, overlap portion 31 of cover 30 slides downward on inclined faces 52 or arc faces 52A of reinforcement ribs 50, thereby going back to the normal engagement position. With this, even when an external force is applied to the housing, deterioration of the appearance of the apparatus is prevented, thereby preventing a gap which may allow foreign material to enter into the housing and thus preventing malfunction of the apparatus.

(4): Further, when the image formation apparatus is assembled, cover 30 can be attached to base 40 by making cover 30 slide along inclined face 52 or arc face 52A. This eases the assembling work.

Second Embodiment

Configuration of Second Embodiment

Figure 11:
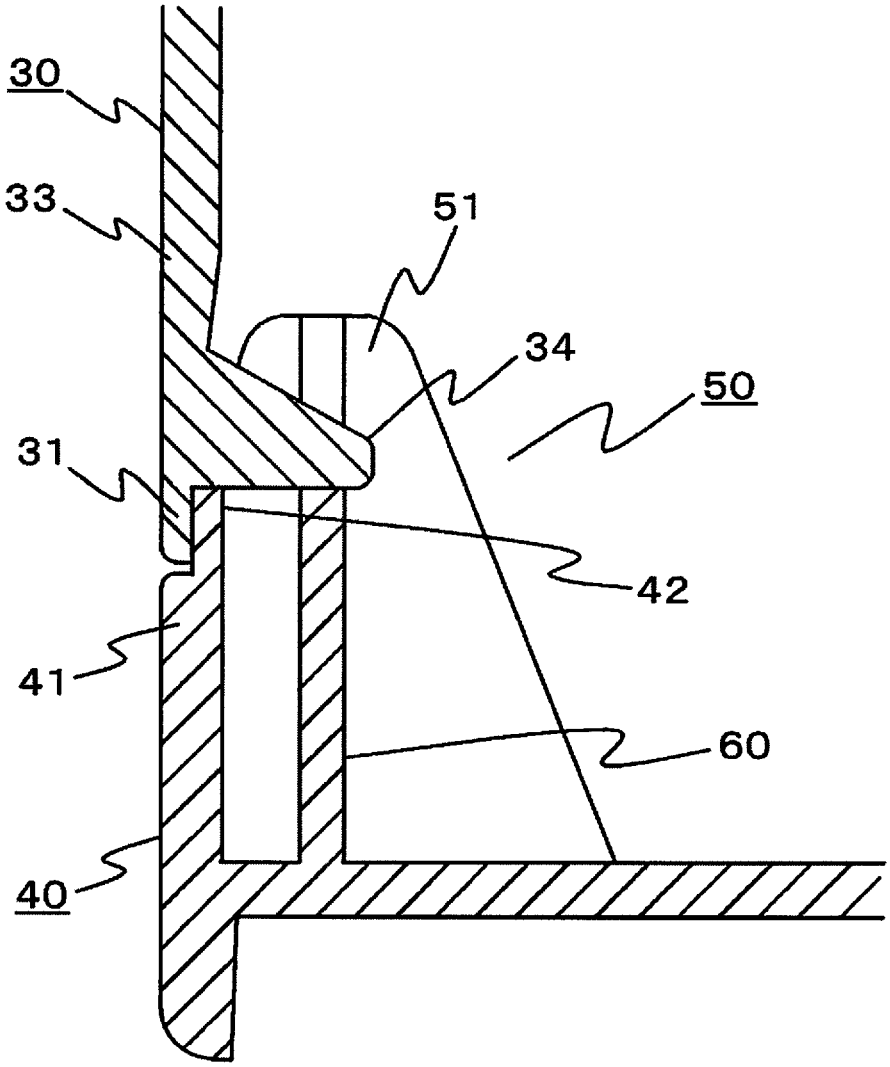
FIG. 11 is a sectional view schematically illustrating a housing engagement structure according to a second embodiment of the invention.

FIG. 11 is a sectional view schematically illustrating an housing engagement structure according to a second embodiment of the invention. In FIG. 11, the same constituents are designated by the same reference numerals as in FIG. 1B illustrating the first embodiment.

As shown in FIG. 11, the housing engagement structure according to the second embodiment further includes: second reinforcement rib 60 projected from and substantially orthogonal to each reinforcement rib 50; and projections 34 (34-1, 34-2, - - - , 34-N) parallel and inwardly projected from cover body 33 of cover 30 at locations above overlap portion 31.

Figure 12:
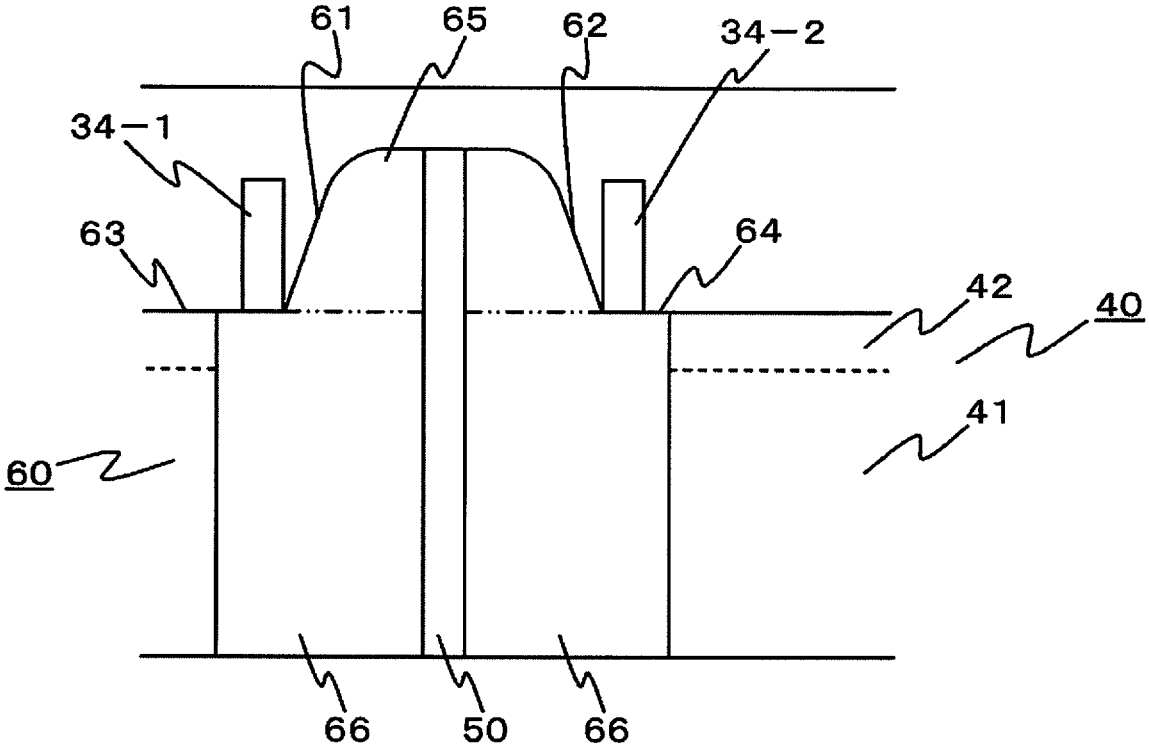
FIG. 12 is a rear view of the housing engagement structure of FIG. 11.

FIG. 12 is a rear view of the housing engagement structure of FIG. 11. Reinforcement rib 60 includes: reinforcement rib body 66 orthogonally intersecting with first rib body 53; and second extension 65 projected upward from the center portion of the upper end of reinforcement rib body 66 and orthogonally intersecting with first extension 51. In other words, reinforcement rib 60 includes: reinforcement rib body 66 orthogonally intersecting with first rib body 53; first support 63 being a part of the upper end of reinforcement rib body 66 and configured to support projection 34-1; second support 64 provided at the opposite side of support 63 and configured to support projection 34-2; and second extension 65 projected upward from between support 63 and support 64 of the upper end of reinforcement rib body 66 and orthogonally intersecting with first extension 51. Both sides of second extension 65 comprise inclined faces 61 and 62 obliquely connecting the top of second extension 65 to supports 63 and 64.

The height of supports 63 and 64 is the same as the height of base 40. Projections 34-1 and 35-2 are disposed on supports 63 and 64. Reinforcement rib 60 is formed symmetrically with respect to reinforcement rib 50.

Figure 13:
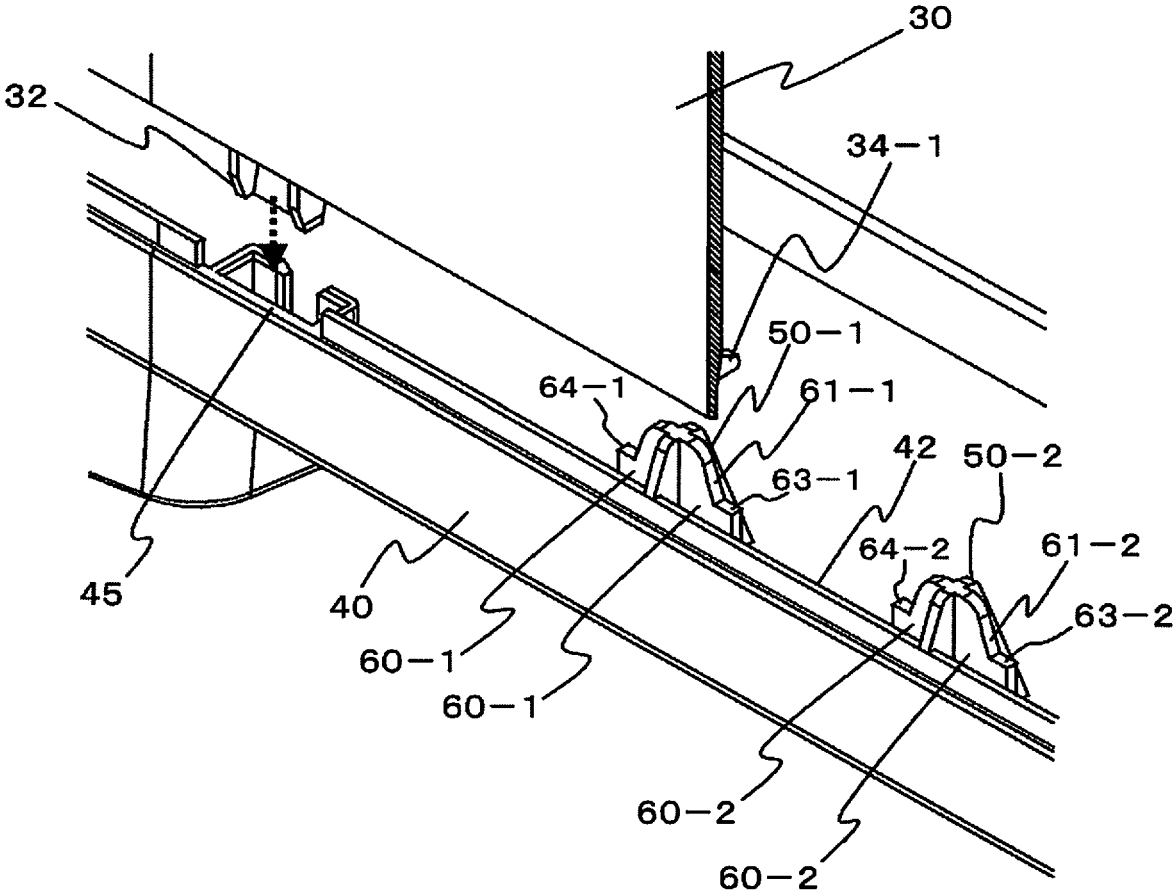
FIG. 13 is a perspective view of the housing engagement structure of FIG. 11.

FIG. 13 is a perspective view of the housing engagement structure of FIG. 11. In FIG. 13, the same constituents are designated by the same reference numerals as in FIG. 5 illustrating the first embodiment.

The housing engagement structure of the second embodiment shown in FIG. 13 is almost the same as the housing engagement structure of the first embodiment shown in FIG. 5.

The difference between the first embodiment and the second embodiment is that the second embodiment includes: projections 34 (34-1, 34-2, - - - , 34-N) projected from cover 30 and extending into the housing; and reinforcement ribs 60 (60-1, 60-2, - - - , 60-N) each of which orthogonally intersects with reinforcement rib 50.

In FIG. 13, reinforcement ribs 50-1 and 60-1 intersecting with each other are disposed behind base 40. Reinforcement ribs 50-2 and 60-2 intersecting with each other and having the same configuration as reinforcement ribs 50-1 and 60-1 are disposed behind base 40 and on the right of reinforcement ribs 50-1 and 60-1 in FIG. 13. When cover 30 is attached to base 90, positioning projection 32 is fit into positioning recess 45 and cover 30 and base 40 are engaged with each other at the same height as those of supports 63 and 64. In this state, projections 34-1 is disposed on support 63.

Function of Second Embodiment

Figure 14:
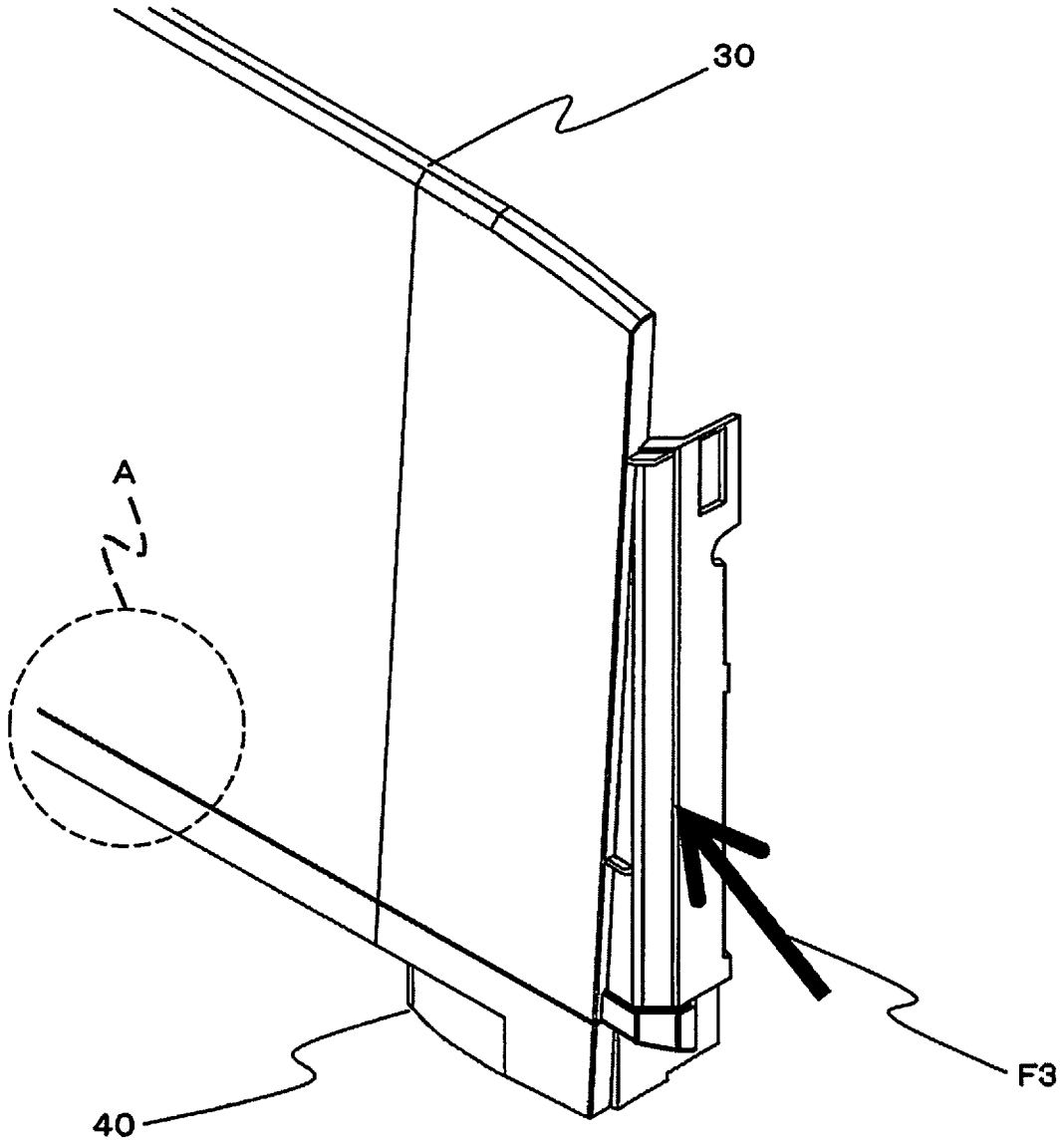
FIG. 14 is a sectional view illustrating a state where external force F3 is applied to the housing engagement structure of FIG. 11.
Figure 15:
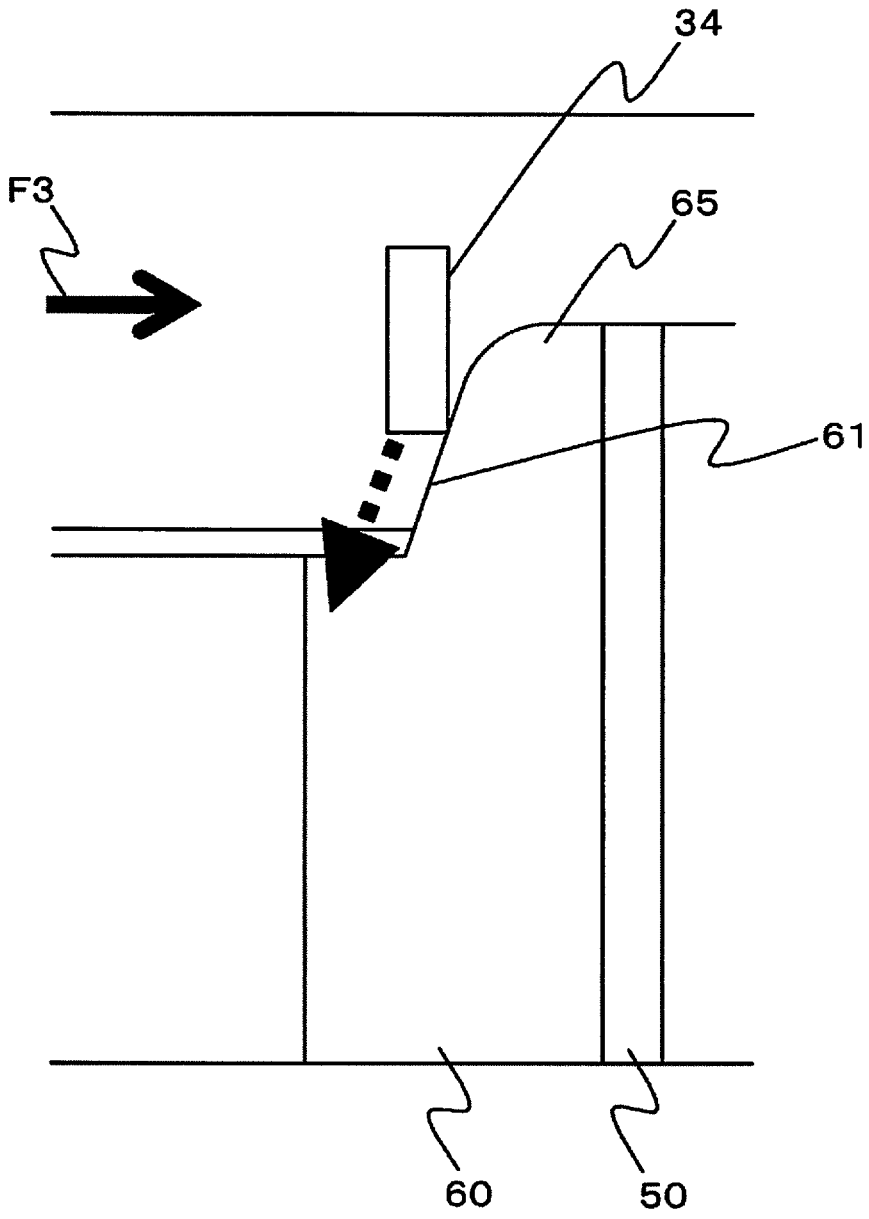
FIG. 15 is a partial enlarged view illustrating portion A in FIG. 14.

FIG. 14 is a sectional view illustrating a state where external force F3 is applied to the housing engagement structure of FIG. 11. FIG. 15 is a partial enlarged view illustrating portion A in FIG. 14.

Referring to FIG. 14, the case where external force F3, which is parallel to the surface of cover 30, is applied to cover 30 by an external cause will be described below.

When external force F3, which is parallel to the surface of cover 30, is applied to cover 30, cover 30 is elastically deformed, projection 34 slides upward along inclined face 61 of reinforcement rib 60, getting on extension 65, as shown in FIG. 15.

After that, when external force F3 disappear, projections 34 slides downwardly along inclined face 61 as cover 30 is restored from the elastically-deformed state to the initial state, thereby cover 30 and base 40 are engaged again.

Figure 16:
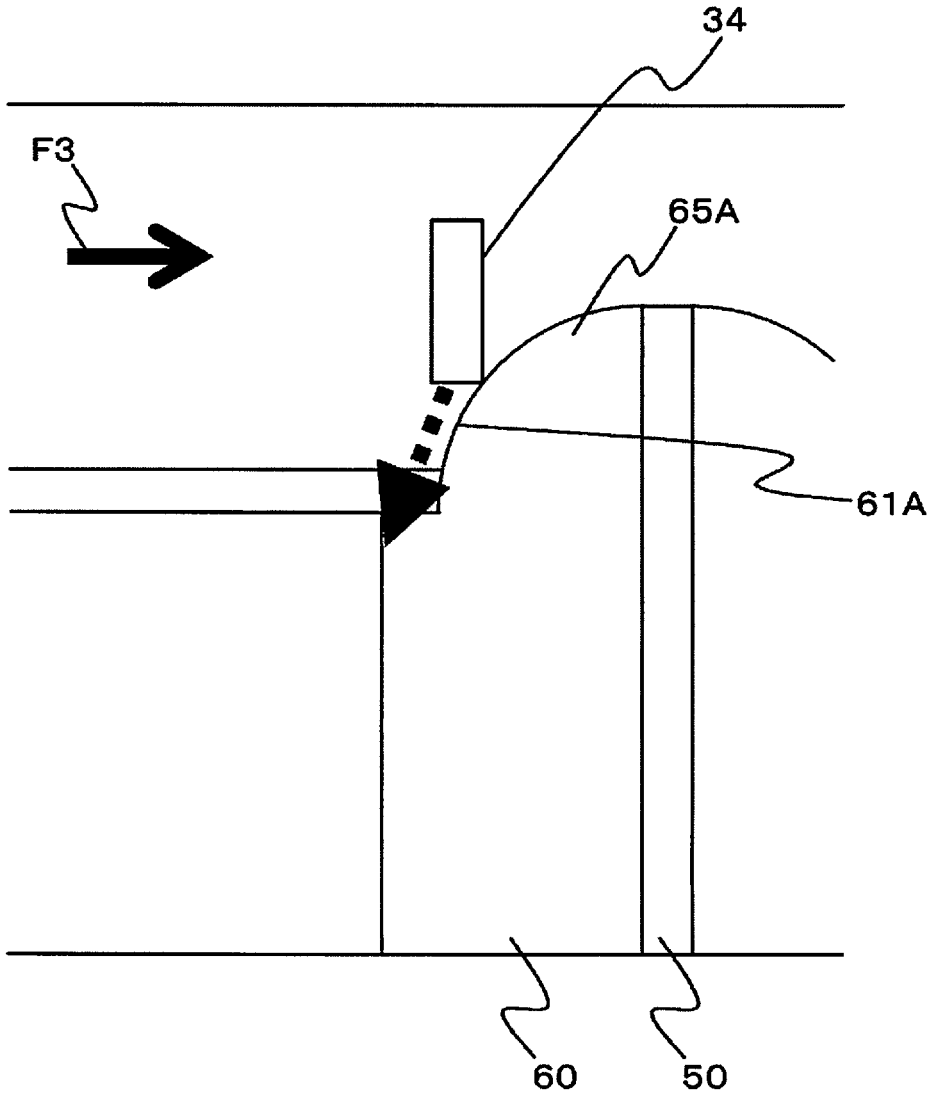
FIG. 16 is a partial enlarged view of a modification of the housing engagement structure of FIG. 14, illustrating a state where external force F3 is applied to portion A in the modification.

FIG. 16 is a partial enlarged view of a modification of the housing engagement structure of FIG. 14, illustrating a state where external force F3 is applied to portion A in the modification.

Extension 65 of reinforcement rib 60 orthogonal to reinforcement rib 50 is formed in a circular shape, that is, extension 65 has arc face 61A being an edge of extension 65. When external force F3, which is parallel to the cover surface, is applied to cover 30, projection 34 slides upward along arc face 61A along extension 65A. After that, when external force F3 is released, projection 34 slides downward along arc face 61A by the weight of cover 30, thereby cover 30 and base 40 are engaged with each other.

Figure 17:
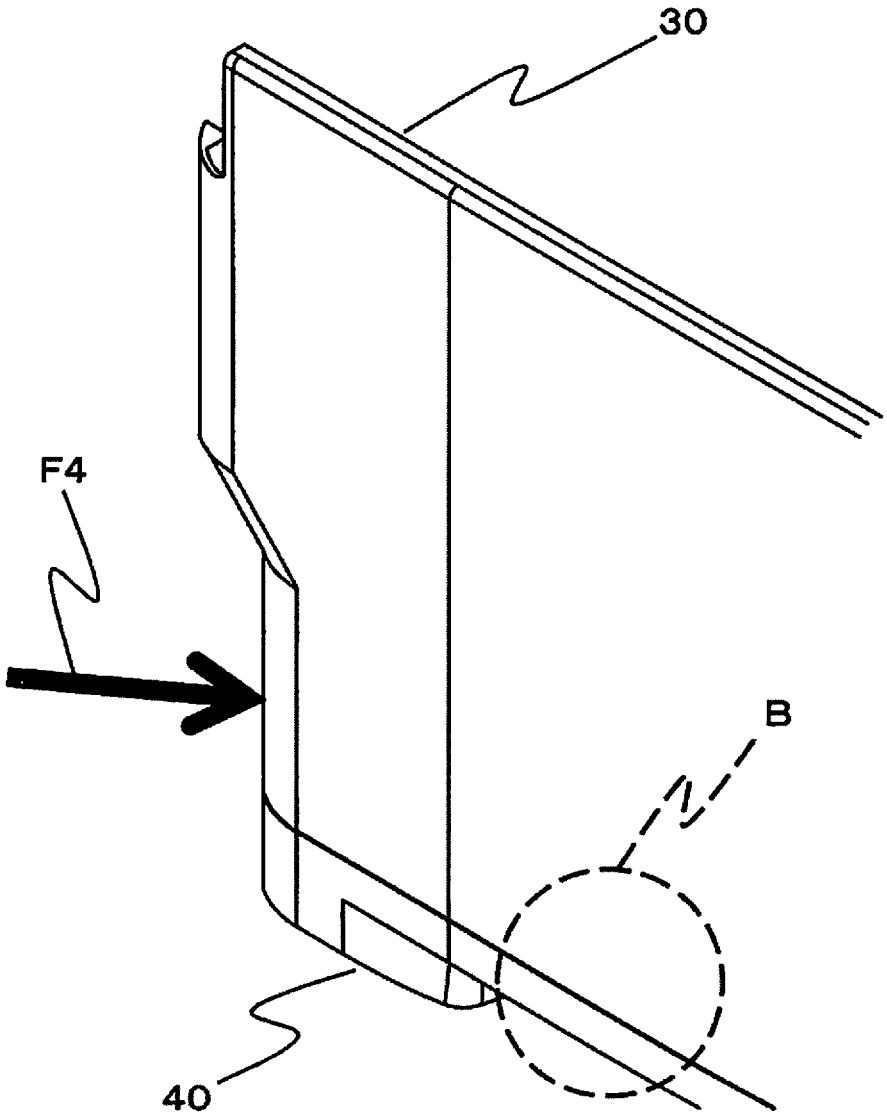
FIG. 17 is a sectional view illustrating a state where external force F9 is applied to the housing engagement structure of FIG. 11.
Figure 18:
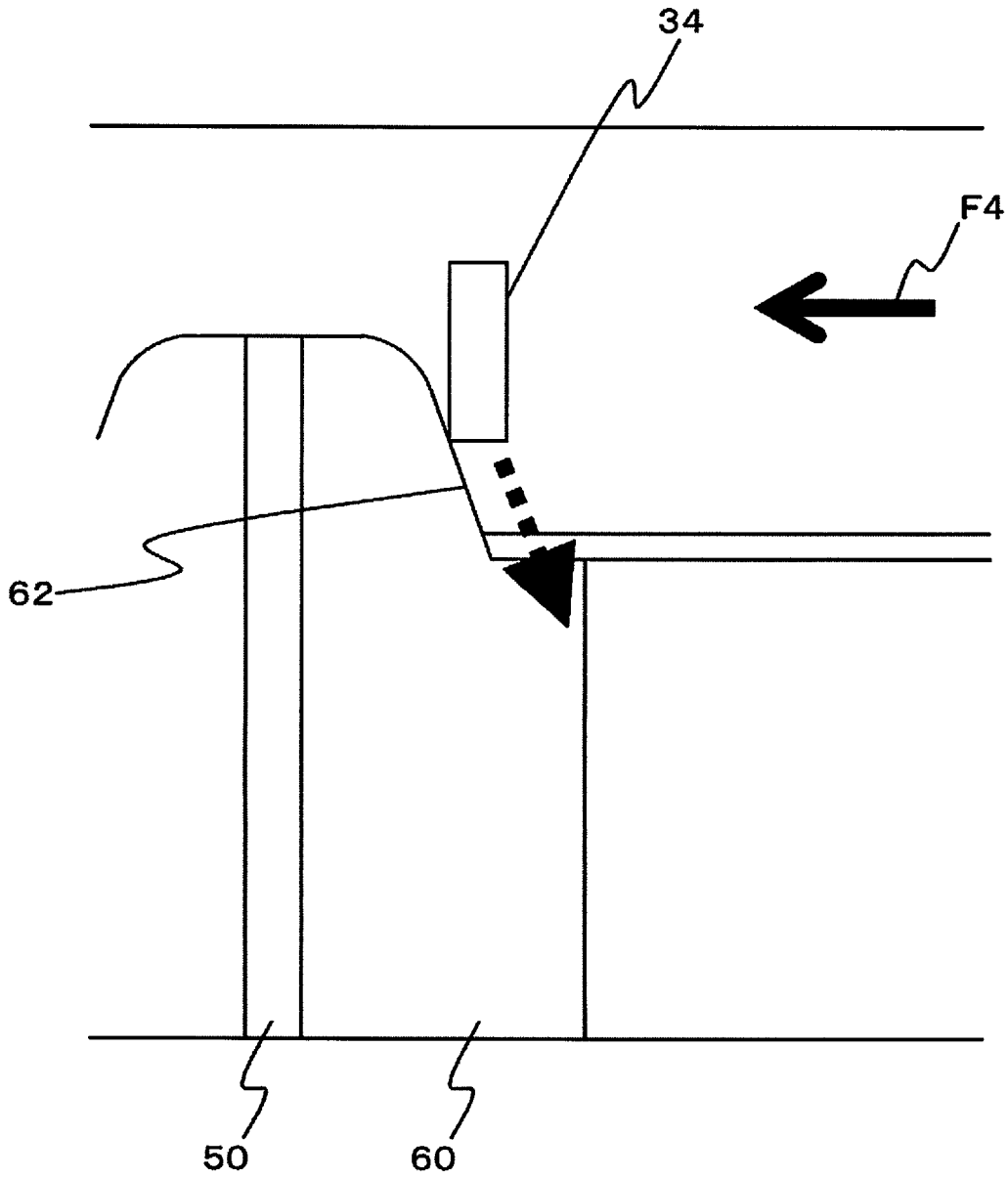
FIG. 18 is a partial enlarged view illustrating portion B shown in FIG. 17, in the same state as in FIG. 17.

FIG. 17 is a sectional view illustrating a state where external force F4 is applied to the housing engagement structure of FIG. 11. FIG. 18 is a partial enlarged view of portion B in FIG. 17.

FIG. 17 illustrating a state where external force F4, which is opposite to external force F3 in FIG. 14, is applied to cover 30A. As shown in FIG. 18, since projections 34 receives external force F4, which is directed opposite to external force F3 in FIG. 15, projections 34 slides upward along inclined face 62 along extension 65. After that, when external force F4 disappears, projections 34 slides downwardly along inclined face 62 by the weight of cover 30, thereby cover 30 and base 40 are engaged with each other.

Modification of Second Embodiment

Figure 19:
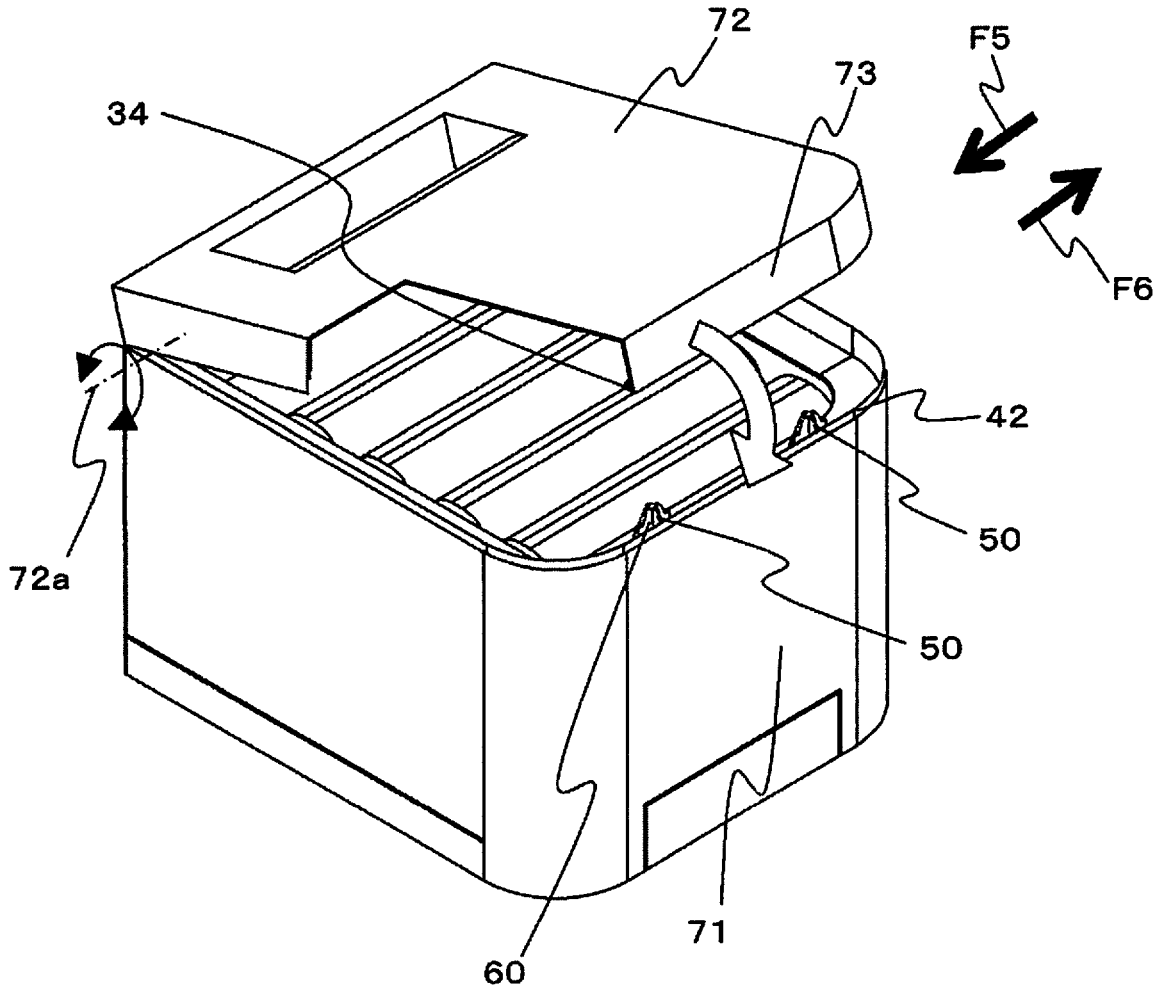
FIG. 19 is a perspective view illustrating a modification of the housing engagement structure of FIG. 11.

FIG. 19 is a perspective view illustrating a modification of the housing engagement structure of FIG. 11.

The housing of the image formation apparatus according to this modification includes: a housing body having an upper opening; and an opening and closing member (for example, access cover 72) to close the upper opening of the housing body. The housing body includes: bottom wall 80 (not shown in FIG. 19); and four side walls surrounding an accommodation space above bottom wall 80. Access cover 72 (a first housing member) to open and close the upper opening of the housing body includes plural sides (four sides in this modification) including a first side and a second side opposite to each other. The first side of access cover 72 is rotatably supported by rotational shaft 72*a* provided at a first side of the upper opening. The second side of access cover 72 is release portion 73 being a free end which is to be engaged with a second side of the upper opening when access cover 72 is closed.

An upper portion of front cover 71 (a second housing member), which forms the front side wall from among the four side wall, is formed with overlap portion 42 (a second overlap portion) at its upper end. The lower end of the release portion 73 is formed with unillustrated overlap portion 31 (a first overlap portion) at a location facing overlap portion 42 of front cover 71.

In other words, access cover 72 is rotatably supported by rotational shaft 72*a* to open and close the upper opening of the housing body, such that access cover 72 is attached to and detached from front cover 71 in a manner that overlap portion 31 of release portion 73 of access cover 72 and overlap portion 42 of front cover 71 can be engaged with each other.

The inner surface of front cover 71 is formed with reinforcement ribs 50 and reinforcement ribs 60 to reinforce overlap portion 42 of front cover 71 from inside.

(Effect of Second Embodiment)

The second embodiment achieves the following effects, in addition to the effects of the housing engagement structure of the first embodiment.

In the first embodiment, the inner surface of base 40 is formed with reinforcement ribs 50 projected from and orthogonal to base 40 and bottom wall 80, thereby reinforcing cover 30 against external force F1 orthogonal to cover 30.

The second embodiment further includes reinforcement rib 60 projected from and substantially orthogonal to reinforcement rib 50. Therefore, the second embodiment reinforces cover 30 against external forces F5 and F6 parallel to cover 30 as well as external force F1 orthogonal to cover 30. Consequently, even through external forces from more directions compared to the first embodiment are received, the second embodiment prevents deterioration of the appearance of the apparatus and prevents a gap which may allow foreign material to enter into the apparatus, thereby preventing malfunction of the apparatus.

(Other Modifications)

The invention is not limited to the above embodiments but various applications and modifications can be made. The followings are examples of the various applications and modifications.

(a): The invention is applied to the housing engagement structure of the image formation apparatus in the first and second embodiments, however, the invention is not limited to this and may be applied to any housing.

(b): The first embodiment describes the case where cover 30 for the exterior is engaged to base 40, however, the invention may be applied to the case where covers are engaged with each other, for example.

(c): The image formation apparatus in the first and second embodiments is the color page printer, however, the image formation apparatus according to the invention is not limited to this and may be a facsimile machine, a copy machine, a MFP (multi-functional peripheral/printer), or the like.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. A housing engagement structure used for a housing to accommodate therein an apparatus body, comprising:

a first housing member including a first wall having a first overlap portion being one end of the first wall; and a second housing member including: a second wall having a second overlap portion being one end of the second wall configured to be in contact with an inner surface of the first overlap portion of the first wall and overlapped with the first overlap portion; and a first reinforcement rib projected from an inner surface of the second wall and extending to a position to be in contact with an inner surface of the first wall in the vicinity of the first overlap portion thereby reinforcing the first overlap portion, wherein the inner surface of the first overlap portion of the first wall and the inner surface of the second overlap portion of the second wall face an interior of the housing within which the apparatus body is accommodate, wherein a portion of the inner surface of the first wall that faces the first reinforcement rib is recessed.

2. The housing engagement structure according to claim 1, wherein the outer surface of the first wall and the outer surface of the second wall are flush with each other except for the second overlap portion.

3. The housing engagement structure according to claim 1, wherein the outer surface of the first wall and the outer surface of the second wall are flush with each other except for the second overlap portion such that the outer surface of the second overlap portion is provided more inside than the outer surface of a body of the second wall.

4. The housing engagement structure according to claim 3, wherein the second wall is formed with a step at a boundary between the outer surface of the second overlap portion and the outer surface of the second wall body.

5. The housing engagement structure according to claim 1, wherein the second housing member further includes a third wall projected from and substantially orthogonal to the second wall, the first reinforcement rib is projected from the second wall and the third wall.

6. The housing engagement structure according to claim 1, wherein the thickness of the first overlap portion is thinner than the thickness of the body of the first wall.

7. The housing engagement structure according to claim 1, wherein the first reinforcement rib includes:

a body of the first reinforcement rib extending in at least an area corresponding to the second overlap portion; and a first extension projected from the end of the first reinforcement rib body, which corresponds to the end of the second overlap portion, and to be in contact with the inner surface of the first wall in the vicinity of the first overlap portion.

8. The housing engagement structure according to claim 7, wherein a side of the first extension that faces the first wall inclines away from the first wall as it goes toward the tip of the first extension.

9. The housing engagement structure according to claim 8 wherein the side of the first extension that faces the inner surface of the first wall is a first inclined face which inclines linearly.

10. The housing engagement structure according to claim 8 wherein the side of the first extension that faces the inner surface of the first wall is a first arc face which inclines in an arc shape.

11. A housing engagement structure used for a housing to accommodate therein an apparatus body, comprising:

a first housing member including a first wall having a first overlap portion being one end of the first wall;

a second housing member including: a second wall having a second overlap portion being one end of the second wall configured to be in contact with an inner surface of the first overlap portion of the first wall and overlapped with the first overlap portion; and a first reinforcement rib projected from an inner surface of the second wall and extending to a position to be in contact with an inner surface of the first wall in the vicinity of the first overlap portion thereby reinforcing the first overlap portion;

a second reinforcement rib projected from and substantially orthogonal to the first reinforcement rib; and projections projecting from the first wall body in the vicinity of the first overlap portion into the housing.

12. The housing engagement structure according to claim 11, wherein the second reinforcement rib comprises:

a body of the second reinforcement rib;

a first support being a part of the end of the second reinforcement rib body and configured to support one of the projections;

a second support being a part of the end of the second reinforcement rib body and configured to support another of the projections; and a second extension projected, between the first support and the second support, from the end of the second reinforcement rib body, wherein both sides of the second extension are second inclined faces obliquely connecting the tip of the second extension and the first and second support.

13. The housing engagement structure according to claim 11, wherein the second reinforcement rib comprises:

a body of the second reinforcement rib;

a first support being a part of the end of the second reinforcement rib body and configured to support one of the projections;

a second support being a part of the end of the second reinforcement rib body and configured to support another of the projections; and a second extension projected, between the first support and the second support, from the end of the second reinforcement rib body, wherein both sides of the second extension are second arc faces obliquely connecting the tip of the second extension and the first and second support.

14. The housing engagement structure according to claim 1, wherein the housing includes: a housing body formed with an opening; and a cover to open and close the opening of the housing body, the first housing member being the cover while the second housing member being a part of the housing body or the entire housing body, the cover is formed with plural sides including a first cover side and a second cover side opposite to each other, the opening of the housing body is formed with plural sides including a first housing side and a second housing side opposite to each other, the first cover side is rotatably attached to the first housing side of the opening of the housing body and the second cover side is a free end to be engaged with the second housing side of the opening, the second side of cover comprises the first overlap portion while the second side of the opening comprises the second overlap portion.

15. An image formation apparatus, comprising:

the housing having the housing engagement structure according to claim 1; and an image formation apparatus main body configured to form an image on a medium and accommodated in the housing.

16. The image formation apparatus according to claim 15, wherein the image formation apparatus main body comprises:

an image formation unit configured to form a developer image;

an image transfer unit configured to transfer the developer image to the medium; and a fixation unit configured to fix the developer image to the medium.

17. The housing engagement structure according to claim 1, wherein the second overlap portion includes an inner surface, an outer surface, and an end surface which connects the outer surface and the inner surface and is substantially orthogonal to the outer surface and the inner surface, and wherein the first reinforcement rib is in flush contact with both the inner surface and the end surface of the second overlap portion.

18. A housing engagement structure used for a housing to accommodate therein an apparatus body, comprising:

a first housing member including a first wall having a first overlap portion being one end of the first wall; and a second housing member including: a second wall having a second overlap portion being one end of the second wall configured to be in contact with an inner surface of the first overlap portion of the first wall and overlapped with the first overlap portion; and a first reinforcement rib projected from an inner surface of the second wall and extending to a position to be in contact with an inner surface of the first wall in the vicinity of the first overlap portion thereby reinforcing the first overlap portion, wherein the inner surface of the first overlap portion of the first wall and the inner surface of the second overlap portion of the second wall face an interior of the housing within which the apparatus body is accommodated, wherein a portion of the first reinforcement rib extends higher than a top of the second wall.

19. The housing engagement structure according to claim 1, wherein one of the first wall and the second wall is formed with a positioning recess and the other of the first wall and the second wall is formed with a positioning projection configured to be fitted in the positioning recess.

20. The housing engagement structure according to claim 1, wherein the first reinforcement rib extends from an first end of the second wall to a location past a second end of the second wall, such that the first reinforcement rib has a greater length than the second wall.

* * * * *